US011421666B2

(12) United States Patent
Trinchieri

(10) Patent No.: US 11,421,666 B2
(45) Date of Patent: Aug. 23, 2022

(54) CARTRIDGE PUMP

(71) Applicant: DANA MOTION SYSTEMS ITALIA S.R.L., Reggio Emilia (IT)

(72) Inventor: Piergiorgio Trinchieri, Trento (IT)

(73) Assignee: DANA MOTION SYSTEMS ITALIA S.R.L., Reggio Emilia (IT)

( * ) Notice: Subject to any disclaimer, the term of this patent is extended or adjusted under 35 U.S.C. 154(b) by 5 days.

(21) Appl. No.: 16/765,460

(22) PCT Filed: Nov. 16, 2018

(86) PCT No.: PCT/EP2018/081532
§ 371 (c)(1),
(2) Date: May 19, 2020

(87) PCT Pub. No.: WO2019/096982
PCT Pub. Date: May 23, 2019

(65) Prior Publication Data

US 2020/0277942 A1 Sep. 3, 2020

(30) Foreign Application Priority Data

Nov. 20, 2017 (EP) ..... 17425114

(51) Int. Cl.
*F04B 9/14* (2006.01)
*F04B 49/10* (2006.01)
(Continued)

(52) U.S. Cl.
CPC ..... *F04B 9/14* (2013.01); *F04B 49/103* (2013.01); *F04B 49/22* (2013.01); *F04B 49/24* (2013.01);
(Continued)

(58) Field of Classification Search
CPC .. F04B 9/14; F04B 49/22; F04B 49/24; F04B 53/1002
See application file for complete search history.

(56) References Cited

U.S. PATENT DOCUMENTS 3,081,007 A 3/1963 Lightburn
3,635,595 A * 1/1972 Allard ..... F04B 9/14 417/426
(Continued)

FOREIGN PATENT DOCUMENTS

DE 10206084 A1 8/2003
EP 0332279 A1 9/1989
(Continued)

OTHER PUBLICATIONS

ISA European Patent Office, International Search Report and Written Opinion Issued in Application No. PCT/EP2018/081532, dated Jan. 10, 2019, WIPO, 12 pages.
(Continued)

*Primary Examiner* — Patrick Hamo
(74) *Attorney, Agent, or Firm* — McCoy Russell LLP

(57) ABSTRACT

A cartridge hand pump is disclosed. The cartridge hand pump comprises a housing; a lever extending from the housing; a cylinder provided in the housing wherein the cylinder is connected to a supply passage for receiving hydraulic fluid and to an actuator passage for sending pressurised hydraulic fluid; and a piston slidably positioned in the cylinder, the piston being operably connected to the lever for movement between a first position and a second position wherein the movement of the piston from the first to the second position sends pressurised fluid to the actuator passage characterised by a pressure relief valve accommodated in the housing wherein the pressure relief valve is in communication with the actuator passage such that pres-
(Continued)

surised hydraulic fluid is discharged through the pressure relief valve when pressure in the actuator passage exceeds a predetermined value.

20 Claims, 5 Drawing Sheets

(51) Int. Cl.
*F04B 49/22* (2006.01)
*F04B 49/24* (2006.01)
*F04B 51/00* (2006.01)
*F04B 53/10* (2006.01)

(52) U.S. Cl.
CPC ..... *F04B 51/00* (2013.01); *F04B 53/1002* (2013.01); *F04B 2201/0201* (2013.01); *F04B 2205/09* (2013.01)

(56) References Cited

U.S. PATENT DOCUMENTS 5,088,691 A 2/1992 Naber et al.
5,542,252 A 8/1996 Hung
6,053,711 A * 4/2000 Johnson ..... F04B 5/00 417/521
6,405,897 B1 * 6/2002 Jepson ..... A47G 19/183 141/116
2003/0230084 A1 12/2003 Tang et al.
2007/0253846 A1 11/2007 Bakker et al.

FOREIGN PATENT DOCUMENTS

GB 2021683 A 12/1979
NL 8800590 A 10/1989

OTHER PUBLICATIONS

China National Intellectual Property Administration, Office Action and Search Report Issued in Application No. 201880075077.1, dated Dec. 7, 2021, 12 pages.

* cited by examiner

CARTRIDGE PUMP

CROSS-REFERENCE TO RELATED APPLICATIONS

The present application is a U.S. National Phase of International Patent Application Serial No. PCT/EP2018/081532 entitled "CARTRIDGE HAND PUMP," filed on Nov. 16, 2018. International Patent Application Serial No. PCT/EP2018/081532 claims priority to European Patent Application No. 17425114.0 filed on Nov. 20, 2017. The entire contents of each of the above-referenced applications are hereby incorporated by reference for all purposes.

TECHNICAL FIELD

This disclosure relates to the field of hydraulic hand pumps, in particular to the field of hydraulic cartridge hand pumps.

BACKGROUND

Hand pumps are manually operated pumps that use human power to displace fluid. The hand pumps contain hydraulic fluid that is used to pressurise an actuator such as a hydraulic piston/cylinder assembly so as to exert high forces on objects by operating a lever on the pump. The actuator may be hydraulically connected to the hand pump.

The hand pump may have a piston cylinder to pressurise the hydraulic fluid. The hand pump includes an outlet that is connected to an inlet of the actuator in order to transfer the pressurised hydraulic fluid from the pump to the actuator. The hand pump may be in the form of a cartridge unit for use in hydraulic systems.

The present disclosure is directed, at least in part, to improving or overcoming one or more aspects of the prior art system.

BRIEF SUMMARY OF THE INVENTION

The present disclosure describes a cartridge hand pump comprising a housing; a lever extending from the housing; a cylinder provided in the housing wherein the cylinder is connected to a supply passage for receiving hydraulic fluid and to an actuator passage for sending pressurised hydraulic fluid; and a piston slidably positioned in the cylinder, the piston being operably connected to the lever for movement between a first position and a second position wherein the movement of the piston from the first to the second position sends pressurised fluid to the actuator passage characterised by a pressure relief valve accommodated in the housing wherein the pressure relief valve is in communication with the actuator passage such that pressurised hydraulic fluid is discharged through the pressure relief valve when pressure in the actuator passage exceeds a predetermined value.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a cartridge hand pump. The cartridge hand pump may have a pressure relief valve housed therein.

Figure 1:
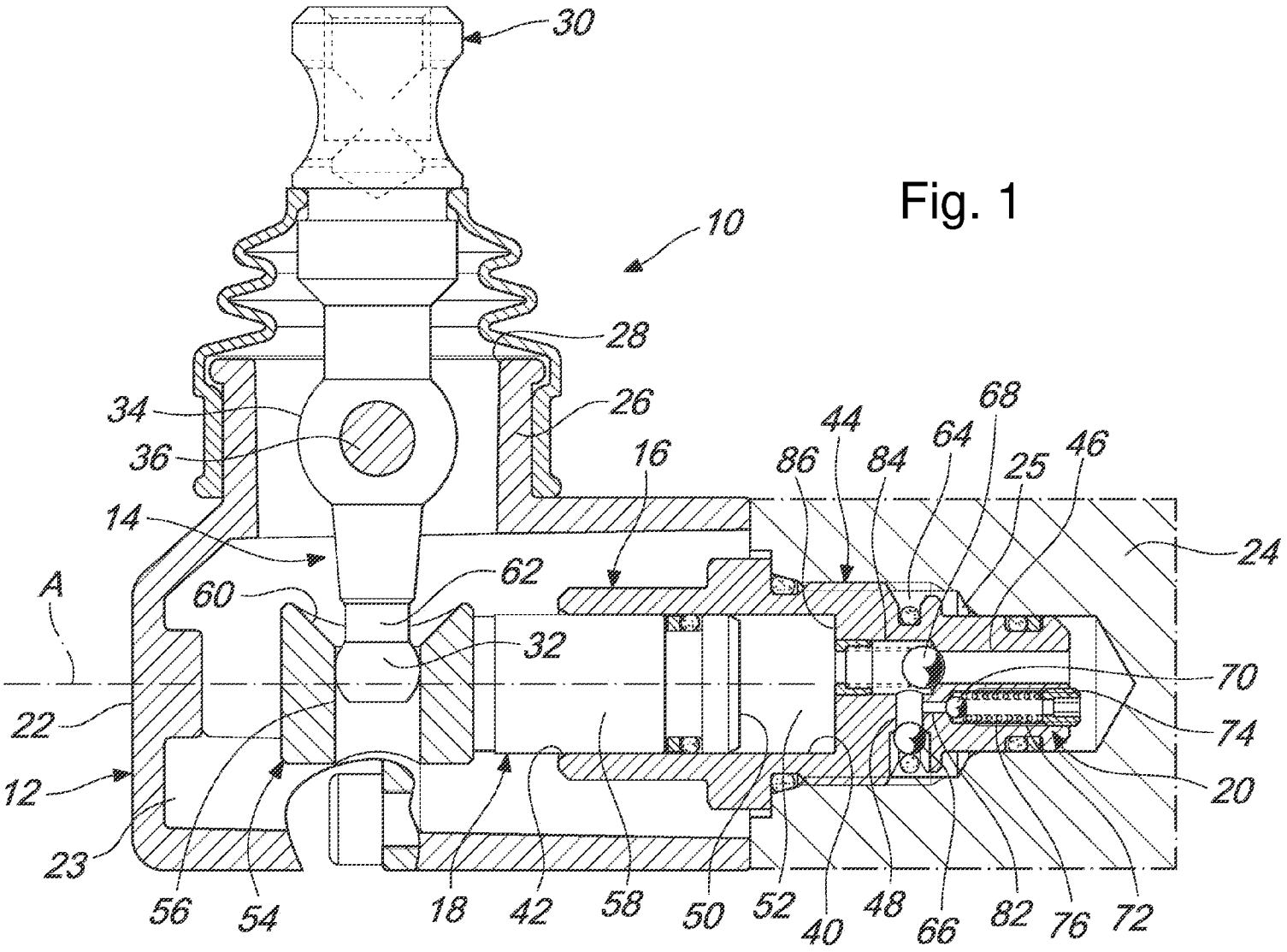
FIG. 1 is a cross-section view of a cartridge hand pump according to the present disclosure.

FIG. 1 illustrates the cartridge hand pump 10. Cartridge hand pump 10 has a housing 12, a lever 14 extending from the housing 12, a cylinder 16 provided in the housing 16, a piston 18 slidably positioned in the cylinder 16 and a pressure relief valve 20 accommodated in the housing 12.

The housing 12 houses the components of the cartridge hand pump 10. The housing 12 has cavities to house the components. Housing 12 accommodates the lever 14, the cylinder 16, the piston 18 and the pressure relief valve 20. Housing 12 has passages for flow of hydraulic fluid therein. Housing 12 has inlets and outlets for flow of fluid into and out of the passages. The inlets and outlets serve for hydraulic fluid connection to a hydraulic system. Hydraulic components such as valves may be positioned in the passages provided in the housing 12. In an embodiment, housing 12 may have a die-cast aluminium body.

Housing 12 may be longitudinally extended along an axis A. In an embodiment, housing 12 may have a first body 22 and a second body 24. First body 22 and second body 24 are coupled to form the housing 12. First body 22 and second body 24 are mutually coupled along a plane substantially parallel to the longitudinal axis A of the housing 12.

First body 22 has a cavity 23 to house a portion of the lever 14, the piston 18 and a portion of the cylinder 16. The lever 14 and the piston 18 are movably housed in the first body 22. First body 22 has a neck 26 protruding perpendicularly to the longitudinal axis A of the housing 12. Lever 14 extends from the housing 12 through an opening 28 in the neck 26.

Second body 24 has a cavity 25 for fixedly accommodating the cylinder 16. Cylinder 16 may be centrally positioned on the second body 24. Second body 24 may be provided with passages and chambers for flow or transfer of fluid.

Lever 14 is axially extended. Lever 14 has a first coupling end 30 and a second coupling end 32. The first coupling end 30 is configured for attachment of a handle (not shown). The second coupling end 32 is configured for operational coupling with the piston 18. In an embodiment, the second coupling end 32 is configured to couple with the piston 18 as a ball joint. The second coupling end 32 is configured as a ball stud.

Lever 14 is pivotably coupled to the housing 12. Lever 14 is pivotably coupled to the neck 26 of the first body 22. In an embodiment, lever 14 is configured to have a pivot socket 34. The pivot socket 34 is centrally positioned on the lever 14. Pivot socket 34 is spaced from the first and second coupling ends 30, 32. In an embodiment, pivot socket 34 is equidistant from both the first and second coupling ends 30, 32.

Pivot socket 34 is configured to couple to a pin 36 formed on the internal surface of the neck 26. Pin 36 has a longitudinal axis that is perpendicular to the longitudinal axis A of the housing 12. The lever 14 is able to pivot about the pin 36. Lever 14 pivots about the pin 36 along a plane that is parallel longitudinal axis A.

Cylinder 16 has a bore 40 that is open towards the cavity 23 and the second coupling end 32. Bore 40 has an opening 42 to receive the piston 18 into the bore 40. In an embodiment, cylinder 16 is positioned such that the central axis of the bore 40 is parallel to the longitudinal axis A of the housing 12. In a further embodiment, central axis of the bore 40 is coincident to the longitudinal axis A.

Cylinder 16 is positioned in the housing 12 so as to axially extend from the second body 24 into the first body 22. Cylinder 16 has a connection end 44 opposite the opening 42. The connection end 44 is an extension of the body of the cylinder 16. The connection end 44 extends axially in a direction opposite to the bore 40. Cylinder 16 is mounted to the housing 12 through the connection end 44. Cylinder 16 is fixedly mounted to the second body 24 through the connection end 44.

Connection end 44 is provided with passages for flow of hydraulic fluid to and from the bore 40. Connection end 44 is provided with outlets and inlets for flow of fluid into and out of the passages. Hydraulic components such as valves may be positioned in the passages provided in the connection end 44.

Cartridge hand pump 10 comprises a supply passage 46. The cylinder 16 is connected to the supply passage 46 for receiving hydraulic fluid. The supply passage 46 may receive hydraulic fluid through a cavity connected to a fluid line connected to hydraulic fluid source. A ball check valve 68 is positioned at the outlet of the supply passage 46 to prevent return flow from the cylinder 16. In an embodiment, the supply passage 46 is positioned in the cylinder 16. In a further embodiment, the supply passage 46 is positioned in the connection end 44. In an alternate embodiment, the supply passage 46 is positioned in the housing 12. Supply passage 46 is integrated in the body of the housing 12.

Cartridge hand pump 10 comprises an actuator passage 48. The cylinder 16 is connected to the actuator passage 48 for sending pressurised hydraulic fluid. The actuator passage 48 connects the cylinder 16 to an actuator (not shown). The pressurised hydraulic fluid is sent to the actuator from the bore 40 of the cylinder 16 through the actuator passage 48.

In an embodiment, the actuator passage 48 may connect the bore 40 of the cylinder 16 to an actuator chamber 64. The actuator may be supplied with pressurised hydraulic fluid from the actuator chamber 64. A ball check valve 66 may be positioned between the actuator passage 48 and the actuator chamber 64 to regulate the flow of hydraulic fluid to the actuator chamber 64. The ball check valve 66 is positioned at the interface of the actuator passage 48 and the actuator chamber 64 to regulate flow of hydraulic fluid into the actuator chamber 64.

In an embodiment, the actuator passage 48 is positioned in the cylinder 16. In a further embodiment, the actuator passage 48 is positioned in the connection end 44. In yet a further embodiment, the actuator chamber 64 may be formed between the connection end 44 and the second body 24. In an alternate embodiment, the actuator passage 48 is positioned in the housing 12. Actuator passage 48 is integrated in the body of the housing 12. In yet a further alternate embodiment, the actuator chamber 64 may be formed in the second body 24.

Piston 18 is axially extended and has a piston head 50 at an end of the body 58 of the piston 18. Piston 18 is slidably positioned in the bore 40 of the cylinder 16. The piston body 58 slidably engages the inner wall of the cylinder 16. The piston head 50 defines a cylinder chamber 52 in the bore 40.

Piston 18 is operably connected to the lever 14. Piston 18 is movable between a first position a second position in the cylinder 16. The pivoting movement of the lever 14 moves the piston 18 between the first position and the second position. The movement of the piston 18 between the first and second position results in hydraulic fluid flowing in and out of the bore 40 of the cylinder 16. The movement of the piston 18 from the second to the first position increases the volume of cylinder chamber 52 and draws fluid from the supply passage 46. The movement of the piston 18 from the first to the second position decreases the volume of cylinder chamber 52 and sends pressurised fluid to the actuator passage 48.

Piston has a mounting end 54 joined to the piston body 58 opposite the piston head 52. The mounting end 54 is configured for operational coupling with the second coupling end 32 of the lever 14. In an embodiment, the mounting end 54 is configured to couple with the lever 14 as a ball joint. The mounting end 54 is configured as a socket to receive the second coupling end 32 configured as a ball stud.

The mounting end 54 configured as a socket may comprise a through central hole 56 for insertion of the second coupling end 32 configured as a ball stud. The ball stud is configured to swivel in the central hole 56. The pivoting motion of the lever 14 effects a linear translation motion of the piston 18 through the interaction of second coupling end 32 and the mounting end 54. As the lever 14 pivots the ball stud swivels relative to the socket so as to cause the piston 18 a linear motion in the cylinder 16.

Central hole 56 extends through the mounting end 54. Central hole 56 may be orthogonal to the central axis of the piston 18. The position and alignment of the central hole 56 relative to the piston body 58 is fixed.

The mounting end 54 has a guide bore 60 at the side facing the lever 14. Guide bore 60 has flared sides that lead to the central hole 56. Lever 14 has a stem 62 positioned adjacent to the second coupling end 32. Stem 62 is positioned so as to be surrounded by the guide bore 60. Stem 62 has a reduced diameter relative to the adjacent portion connecting to the pivot socket 34.

In an embodiment, the pressure relief valve 20 is positioned in the cylinder 16. In a further embodiment, the pressure relief valve 20 is positioned in the connection end 44. In an alternate embodiment, the pressure relief valve 20 is positioned in the housing 12. Pressure relief valve 20 is integrated in the body of the housing 12.

Figure 2:
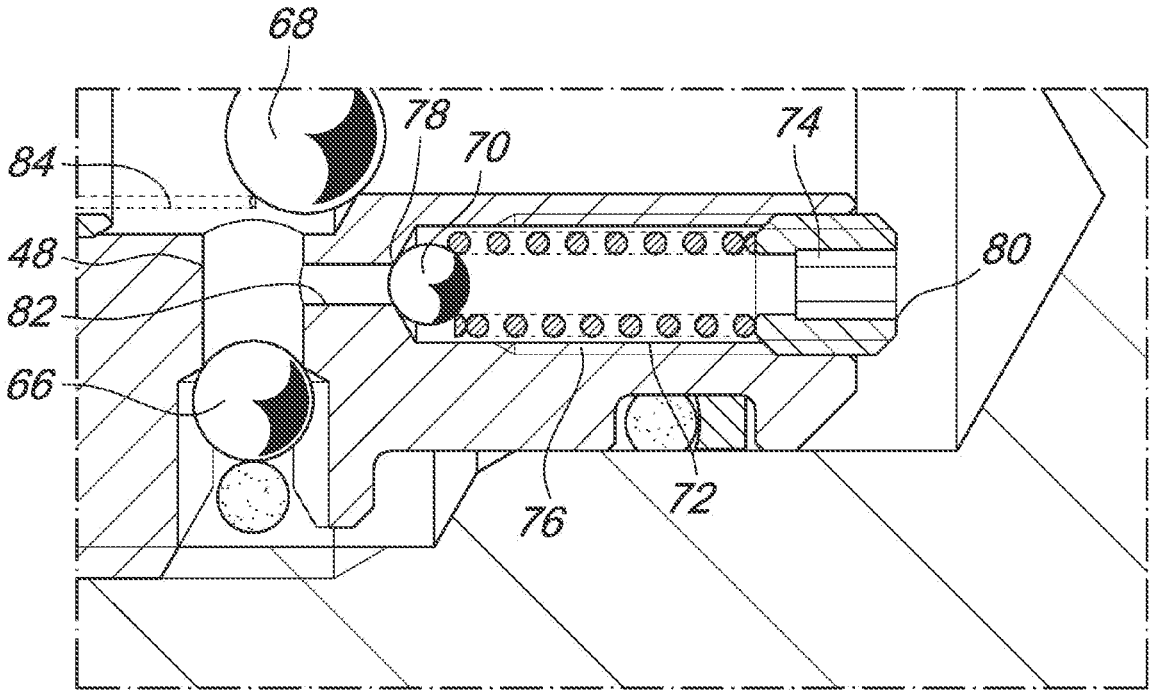
FIG. 2 is an enlarged view of a pressure relief valve of the cartridge hand pump of FIG. 1.

With reference to FIG. 2, the pressure relief valve 20 is in communication with the actuator passage 48 such that pressurised hydraulic fluid is discharged through the pressure relief valve 20 when pressure in the actuator passage 48 exceeds a predetermined value.

In an embodiment, pressure relief valve 20 is a ball check valve formed by a ball 70 and a resilient member 72. The resilient member 72 may be a spring. A screw adjuster 74 is provided to regulate the spring load. The screw adjuster 74 enables the pressure load of the ball check valve to be pre-set. The screw adjuster 74 has a central hole that permits flow of pressurised hydraulic fluid. The pressure relief valve 20 enables pressurised hydraulic fluid to be discharged from the actuator passage 48 when the pressure load of the pressurised hydraulic fluid exceeds the pressure load of the of the pressure relief valve 20.

The pressure relief valve 20 is positioned in a cavity 76 in communication with the actuator passage 48. The cavity 76 extends perpendicular to the actuator passage 48. The ball 70 is positioned at the inlet 78 of the cavity 76 and the screw adjuster 74 is positioned at the outlet 80 of the cavity 76. The central axis of the cavity 76 is parallel to the central axis of the supply passage 46. The cavity 76 is positioned next to the supply passage 46.

In an embodiment, the cavity 76 is positioned in the cylinder 16. In a further embodiment, the cavity 76 is positioned in the connection end 44. In an alternate embodiment, the cavity 76 is positioned in the housing 12. Cavity 76 is formed in the body of the housing 12.

In an embodiment, a conduit 82 connects the cavity 76 to the actuator passage 48. Conduit 82 extends perpendicular to the actuator passage 48. Conduit 82 extends axially from the cavity 76 to the actuator passage 48.

In an embodiment, the conduit 82 is positioned in the cylinder 16. In a further embodiment, the conduit 82 is positioned in the connection end 44. In an alternate embodiment, the conduit 82 is positioned in the housing 12. Conduit 82 is formed in the body of the housing 12.

Cartridge hand pump 10 comprises a two-way passage 84. In an embodiment. the supply passage 46 and the actuator passage 48 are connected to the cylinder 16 through the two-way passage 84. The supply passage 46 and the actuator passage 48 are connected to the bore 40 of the cylinder 16 through the two-way passage 84. Hydraulic fluid from the supply passage 46 passes through the two-way passage 84 to the bore 40. Pressurised hydraulic fluid from the bore 40 passes through the two-way passage 84 to the actuator passage 48.

In an embodiment, the two-way passage 84 is positioned in the cylinder 16. In a further embodiment, the two-way passage 84 is positioned in the connection end 44. The two-way passage 84 opens to a cylinder head 86 of the cylinder 16. In an alternate embodiment, the two-way passage 84 is positioned in the housing 12. Two-way passage 84 is formed in the body of the housing 12.

The two-way passage 84 extends axially relative to the cylinder 16. In an embodiment, the central axis of the two-way passage 84 is parallel to the central axis of the bore 40. The central axis of the two-way passage 84 is parallel to the longitudinal axis A of the housing 12.

The supply passage 46 extends longitudinally from the two-way passage 84. Ball check valve 68 is positioned at the interface of the supply passage 46 and the two-way passage 84 to prevent return flow from the cylinder 16.

The actuator passage 48 extends perpendicularly from the two-way passage 84. The junction of the actuator passage 48 and the two-way passage 84 is adjacent to the interface of the supply passage 46 and the two-way passage 84.

Figure 3:
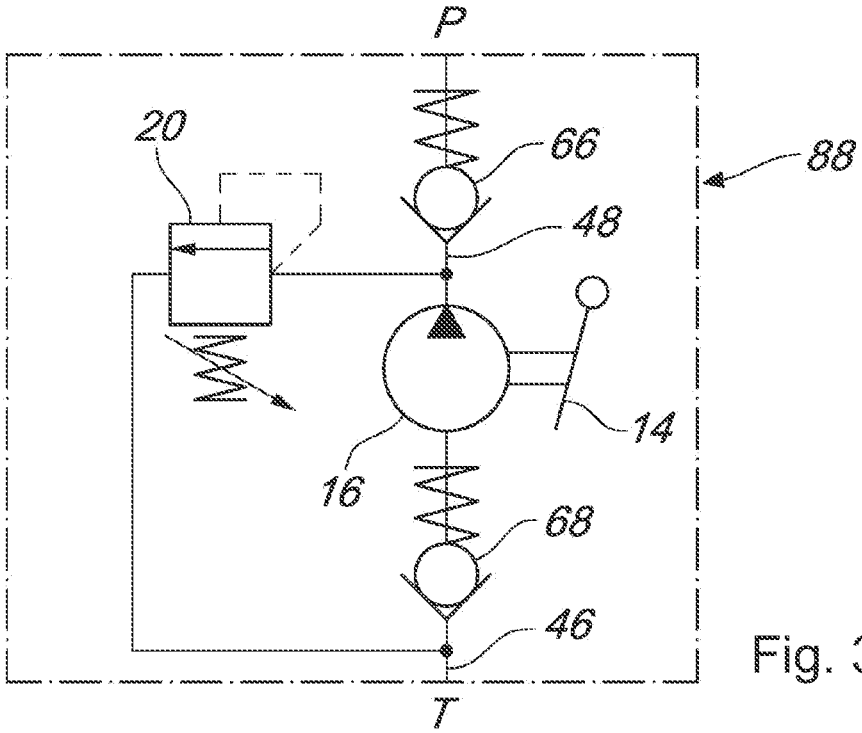
FIG. 3 is a schematic drawing of the hydraulic circuit of the cartridge hand pump of FIG. 1.

FIG. 3 illustrates a hydraulic circuit 88 provided in the cartridge hand pump 10. The hydraulic circuit 88 shows the supply passage 46 leading to the cylinder 16. Cylinder 16 is connected to the actuator passage 48. Cylinder 16 is connected the lever 14. The pressure relieve valve 20 is connected to the actuator passage 48.

Figure 4:
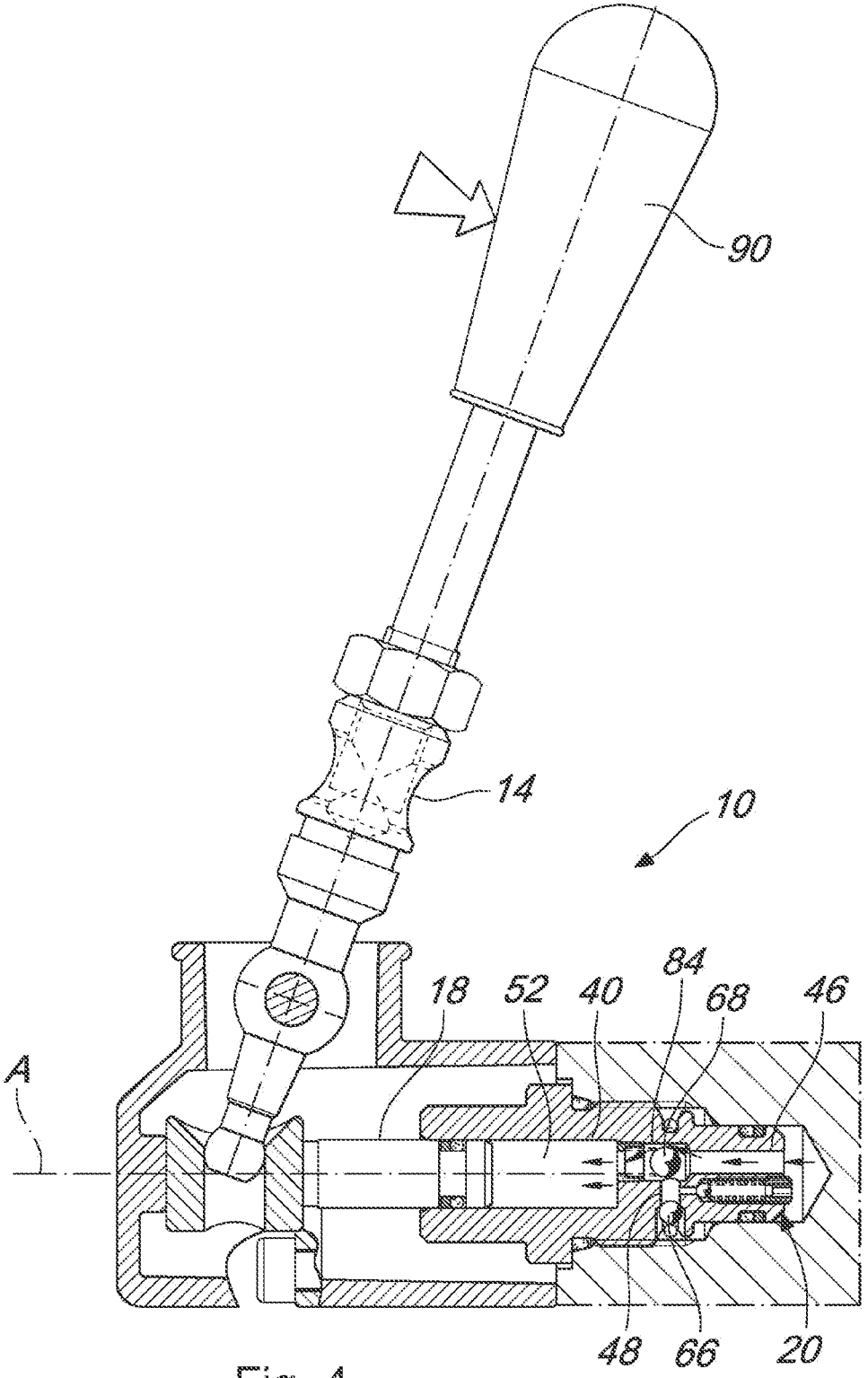
FIG. 4 is a cross-section view of the cartridge hand pump actuated to draw in hydraulic fluid.

With reference to FIG. 4, in operation, the lever 14 is actuated by a handle 90 connected to the first coupling end 30. The lever 14 is actuated to move between two end points so as to move the piston 18 between a first position and a second position. When the lever 14 is actuated to move the piston 18 towards the first position, the chamber 52 increases in volume thereby creating a low pressure zone. The decreased pressure draws hydraulic fluid through the supply passage 46 into the bore 40. Ball check valve 68 is displaced to enable flow of the hydraulic fluid from the supply passage 46.

In an embodiment, the hydraulic fluid travels from the supply passage 46 through the two-way passage 84 to bore 40. Hydraulic fluid may move into the actuator passage 48 and to the pressure relief valve 20. As the hydraulic fluid has a low pressure, the ball check valve 66 and the pressure relief valve 20 are not displaced to allow passage of the hydraulic fluid.

Figure 5:
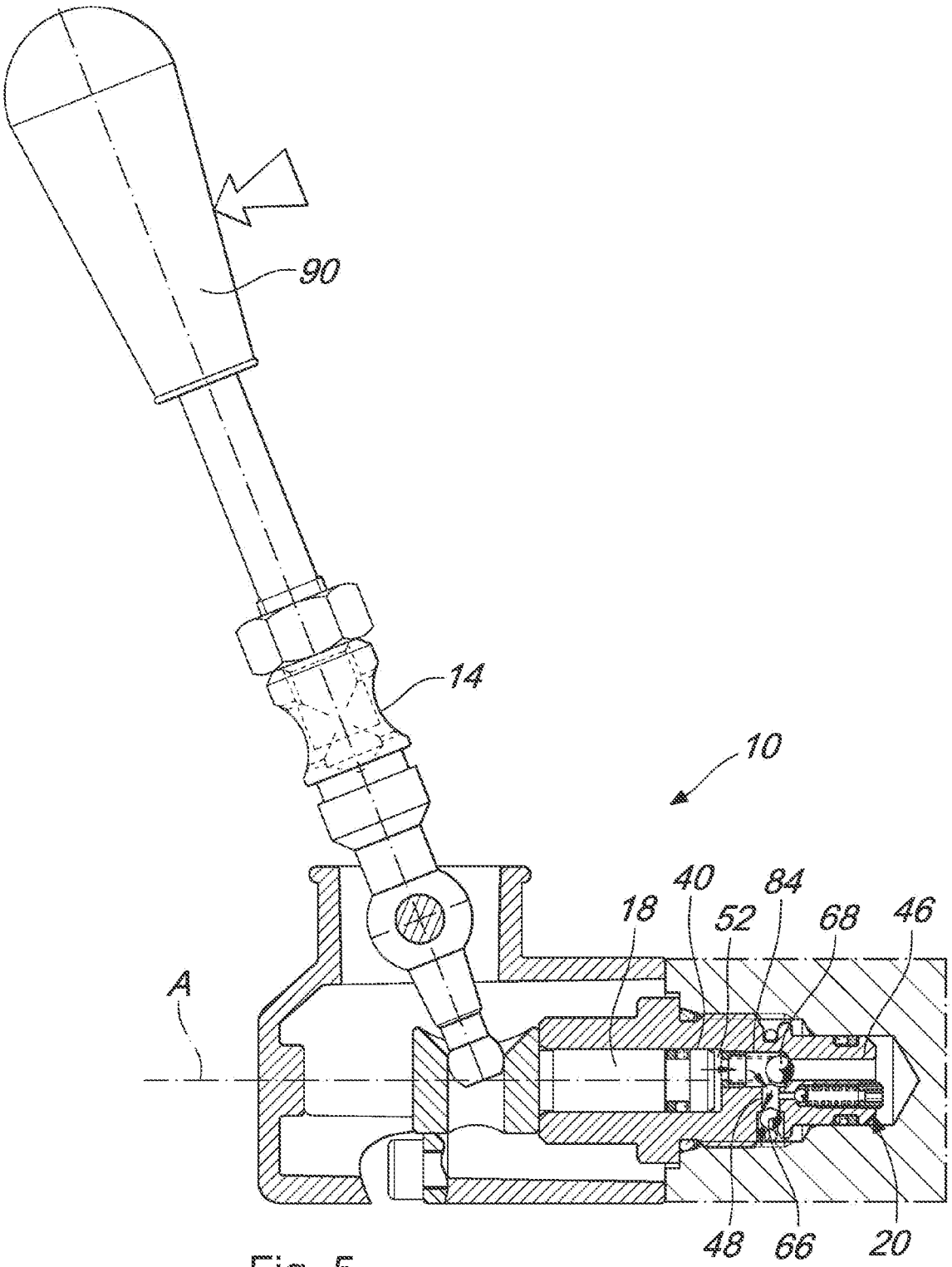
FIG. 5 is a cross-section view of the cartridge hand pump actuated to send out hydraulic fluid.

With reference to FIG. 5, when the lever 14 is actuated to move the piston 18 towards the second position, the chamber 52 decreases in volume thereby creating a high pressure zone. The increased pressure pressurises and pushes hydraulic fluid from the bore 40 into the actuator passage 48 to the actuator. The pressure in the hydraulic fluid is sufficient to displace ball check valve 66. The pressure in the hydraulic fluid may not be sufficient to displace the pressure relief valve 20 for discharge of the hydraulic fluid.

In an embodiment, the hydraulic fluid travels from the bore 40 through the two-way passage 84 to the actuator passage 48. The flow of pressurised hydraulic fluid into the supply passage 46 is prevented by the ball check valve 68.

Figure 6:
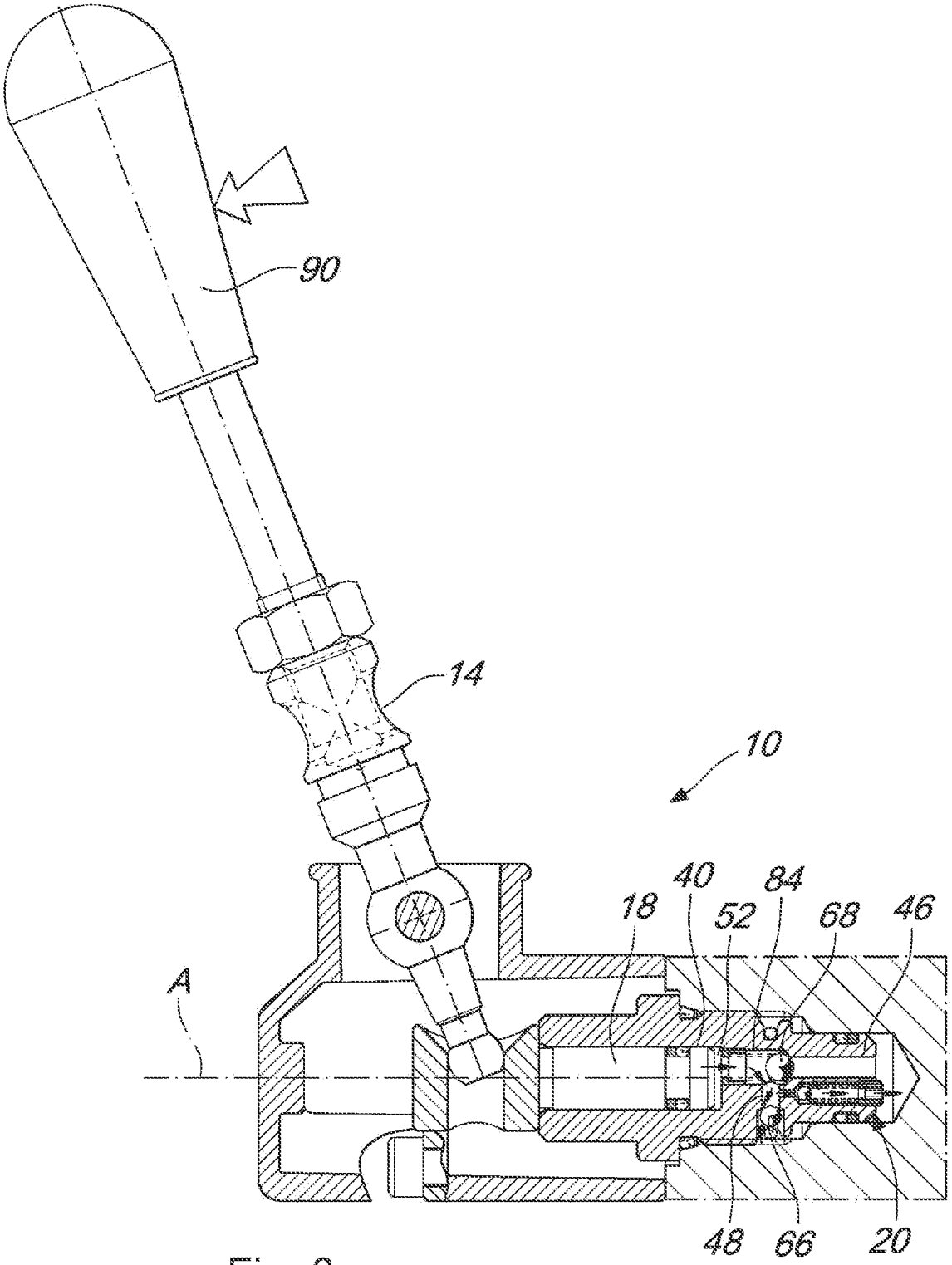
FIG. 6 is a cross-section view of the cartridge hand pump with hydraulic fluid at a pressure exceeding a predetermined pressure value.

With reference to FIG. 6, when the actuator connected to the actuator passage 48 reaches the end of the stroke, the pressure in actuator passage 48 rises to a predetermined pressure of the pressure relief valve 20. The pressure relief valve 20 is displaced and discharges pressurised hydraulic fluid to maintain constant pressure at the predetermined pressure value.

The skilled person would appreciate that foregoing embodiments may be modified or combined to obtain the cartridge hand pump 10 of the present disclosure.

INDUSTRIAL APPLICABILITY

This disclosure describes a cartridge hand pump 10. Cartridge hand pump 10 has an integrated pressure relief valve. The integrated pressure relief valve may limit the maximum pressure in the cartridge hand pump 10 thereby reducing the potential for a component malfunction or damage in the housing due to extreme pressures. The cartridge hand pump 10 may have an improved safety feature. Further, the number of valves, amount of machining and assembly time may be reduced in the production of the cartridge hand pump 10.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The disclosures in European Patent Application No. 17425114.0 from which this application claims priority are incorporated herein by reference.

The invention claimed is:

1. A cartridge hand pump comprising:

a housing;

a lever having a first coupling end and a second coupling end, wherein the lever extends from the housing;

a cylinder provided in the housing wherein the cylinder is connected to a supply passage for receiving hydraulic fluid and to an actuator passage for sending pressurised hydraulic fluid; and a piston slidably positioned in the cylinder, the piston being operably connected within the housing to the lever for movement between a first position and a second position wherein the movement of the piston from the first to the second position sends pressurised fluid to the actuator passage;

wherein a pressure relief valve is accommodated in the housing, wherein the pressure relief valve is in communication with the actuator passage such that pressurised hydraulic fluid is discharged through the pressure relief valve when pressure in the actuator passage exceeds a predetermined value.

2. The cartridge hand pump of claim 1 wherein pressure relief valve is positioned in a cavity in communication with the actuator passage.

3. The cartridge hand pump of claim 2 wherein the cavity extends perpendicular to the actuator passage.

4. The cartridge hand pump of claim 2 wherein the pressure relief valve is a ball check valve.

5. The cartridge hand pump of claim 4 wherein the ball check valve comprises a spring and a screw adjuster for regulating a spring load of the spring.

6. The cartridge hand pump of claim 5 wherein a ball of the ball check valve is positioned at an inlet of the cavity and the screw adjuster is positioned at an outlet of the cavity.

7. The cartridge hand pump of claim 2 wherein a conduit connects the cavity to the actuator passage.

8. The cartridge hand pump of claim 7 wherein the conduit extends perpendicular to the actuator passage.

9. The cartridge hand pump of claim 1 wherein the pressure relief valve is provided in a body of the housing.

10. The cartridge hand pump of claim 1 wherein the pressure relief valve is provided in a connection end of the cylinder.

11. The cartridge hand pump of claim 1 wherein the supply passage and the actuator passage are connected to the cylinder through a two-way passage.

12. The cartridge hand pump of claim 11 wherein the two-way passage extends axially relative to the cylinder.

13. The cartridge hand pump of claim 11 wherein the supply passage extends longitudinally from the two-way passage.

14. The cartridge hand pump of claim 11 wherein the actuator passage extends perpendicularly from the two-way passage.

15. The cartridge hand pump of claim 11 wherein the two-way passage and the actuator passage are provided in a connection end of the cylinder.

16. The cartridge hand pump of claim 1, wherein the pressure relief valve is positioned within the cylinder at a first end of the piston.

17. A system, comprising:

a cartridge hand pump comprising:

a housing;

a lever extending from the housing;

a cylinder provided in the housing wherein the cylinder is configured to be connected to a supply passage for receiving hydraulic fluid and to an actuator passage for sending pressurised hydraulic fluid; and a piston slidably positioned in the cylinder, the piston being operably connected to the lever for movement between at least a first position and a second position wherein the movement of the piston from the first to the second position sends pressurised fluid to the actuator passage, wherein a pressure relief valve positioned within the cylinder at a first end of the piston is accommodated in the housing, wherein the pressure relief valve is in communication with the actuator passage such that pressurised hydraulic fluid is discharged through the pressure relief valve when pressure in the actuator passage exceeds a predetermined value.

18. The system of claim 17, wherein the piston is operably connected within the housing to the lever.

19. The system of claim 18, wherein the cylinder has a bore which accommodates the lever within the housing.

20. The system of claim 17, wherein the lever has a first coupling end coupled to a handle and a second coupling end operably coupled to the piston within the housing.

* * * * *